US012385165B2

(12) United States Patent
Anderegg et al.

(10) Patent No.: US 12,385,165 B2
(45) **Date of Patent: *Aug. 12, 2025**

(54) CARDER

(71) Applicant: Maschinenfabrik Rieter AG, Winterthur (CH)

(72) Inventors: Peter Anderegg, Winterthur (CH); Christian Sauter, Flurlingen (CH); Thomas Walther, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

This patent is subject to a terminal disclaimer.

(21) Appl. No.: 18/166,138

(22) Filed: Feb. 8, 2023

(65) Prior Publication Data

US 2023/0257913 A1 Aug. 17, 2023

(30) Foreign Application Priority Data

Feb. 11, 2022 (CH) ..... 126/2022

(51) Int. Cl.
*D01G 15/36* (2006.01)
*D01G 15/16* (2006.01)
*D01G 31/00* (2006.01)

(52) U.S. Cl.
CPC ..... *D01G 15/36* (2013.01); *D01G 15/16* (2013.01); *D01G 31/006* (2013.01)

(58) Field of Classification Search
CPC ..... G01H 1/003
USPC ..... 700/142, 143
See application file for complete search history.

(56) References Cited

U.S. PATENT DOCUMENTS

2002/0050027 A1* 5/2002 Leder ..... D01G 15/28 19/103
2007/0033917 A1* 2/2007 Pferdmenges ..... D01G 15/28 57/264
2007/0089275 A1* 4/2007 Breuer ..... D01G 15/28 19/54
2007/0266528 A1* 11/2007 Farber ..... D01G 15/28 19/98
2008/0220695 A1* 9/2008 Kamphausen ..... D01G 15/38 451/131

(Continued)

FOREIGN PATENT DOCUMENTS

CH 695 351 A5 4/2006
DE 39 13 996 A1 8/1990

(Continued)

OTHER PUBLICATIONS

Swiss Patent Office Search Report, Mar. 24, 2022.

*Primary Examiner* — Aiying Zhao
(74) *Attorney, Agent, or Firm* — Dority & Manning, P.A.

(57) ABSTRACT

A carder has a drum formed as a hollow cylinder having a drum wall, a longitudinal axis, a circumference, an outer surface, a length, and a clothing provided on the outer surface. Working elements are arranged relative to the outer surface of the drum. Stub axles or a continuous axle is formed along the longitudinal axis of the drum and connected to the drum wall by spokes or disks. One or more acceleration sensors that measures structure-borne sound are mounted on one or more of: a side of the drum wall facing the longitudinal axis, the stub axles, the continuous axle, the spoked, or the disks within the length of the drum.

15 Claims, 3 Drawing Sheets

(56) References Cited

U.S. PATENT DOCUMENTS

| | | | | |
|---|---|---|---|---|
| 2017/0146989 | A1* | 5/2017 | Locatelli | G05B 23/0283 |
| 2020/0027339 | A1 | 1/2020 | Gutberlet et al. | |
| 2022/0161297 | A1* | 5/2022 | Tagawa | B07B 1/42 |

FOREIGN PATENT DOCUMENTS

| | | | | |
|---|---|---|---|---|
| DE | 42 35 610 | A1 | 4/1994 | |
| DE | 69600589 | T2 | 1/1999 | |
| DE | 102 51 574 | A1 | 5/2004 | |
| DE | 102005050904 | A1 | 4/2007 | |
| DE | 10 2006 002 812 | A1 | 7/2007 | |
| DE | 102007005601 | A1 | 11/2007 | |
| DE | 102018010156 | A1 | 7/2020 | |
| EP | 3354774 | A1 * | 8/2018 | D01G 15/08 |
| RU | 30756 | U | 7/2003 | |
| RU | 30756 | U1 * | 7/2003 | |
| WO | WO-2018215885 | A1 * | 11/2018 | D01G 15/16 |

* cited by examiner

CARDER

FIELD OF THE INVENTION

The present invention relates to a carder having a drum with a longitudinal axis, a circumference, and a length, wherein the drum is provided with a clothing on its outer surface. The carder has elements which are arranged vis-à-vis the outer surface of the drum. The drum is designed as a hollow cylinder having a drum wall and along the longitudinal axis at least two stub axles or a continuous axle, wherein the stub axles or the axle are connected to the drum wall by spokes or disks.

BACKGROUND

In a carder, the revolving flats region together with the drum forms the main carding zone, and its function is to break up clusters of fibers to form individual fibers, separate out impurities and dust, eliminate very short fibers, break up neps, and parallelize the fibers. Depending on the use of a carder, fixed flats, revolving flats, or a mixture of fixed and revolving flats are used. A narrow gap, which is called the carding gap, forms between the clothing (needle tips) of the revolving flat and the clothing (saw tooth) of the drum. It results when revolving flats are used, in that the revolving flats, guided by arc-shaped strips—so-called flexible sheets, regulating sheets, flex sheets or sliding sheets—are guided along the circumference of the drum at a distance determined by these strips. With a revolving flat carder, the size of the carding gap is typically between 0.10 to 0.30 mm for cotton, or up to 0.40 mm for synthetic fibers. However, contact with the oppositely situated elements is to be avoided since this can routinely cause damage to the revolving flats as well as to the drum. As a result, determining the actual carding gap is of great importance.

In order to achieve a carding effect as efficient as possible in a carder, it is necessary to keep the carding gap as small as possible, in particular in the main carding zone between the clothing of the revolving flat and the clothing of the drum. The clothing of the drum is applied on the outer surface of the drum of the carder by special tightening methods and fastening methods. In order to achieve high production quantities, the rotational speeds of the drums have been increased more and more in recent years. That is, drums with rotational speeds of over 600 rpm have now come into use. By increasing the rotational speeds, the centrifugal forces on the drum of the carder are increased, which cause non-uniform elastic deformations in the diameter region of the drum of the carder due to the arising non-uniform stresses. As a result of the arising described non-uniform elastic deformations occurring in the drum region, the carding gap set in the idle state can change in the operating state, which can lead to deteriorations of the carding due to loss of carding surface, as well as to collisions of the clothings and thus damage to the clothings. The basis for setting the carding gap is the knowledge of when it is zero, i.e. contact with the oppositely positioned components takes place. In this way, available adjustment devices can be easily calibrated. By precisely determining this contact, exact maintenance of the carding gap can on the one hand be achieved, and damage to the components can on the other hand be avoided.

Various devices and methods are known for determining the carding gap, or contact with the oppositely situated components. For example, DE 10 2006 002 812 A1 describes a device and a corresponding method for determining the carding gap. In the case of a spinning preparation machine, in particular a carder, rolling carder or the like, for monitoring and/or adjusting distances and components, in which a clothed, fast-rotating roller is situated opposite at least one clothed and/or non-clothed component, and the distance between the mutually opposite components can be changed, are electrically insulated from one another. These components are connected to an electrical circuit as respective contact elements, in which electrical circuit there is a measuring element for determining contact. The clothed, fast-rotating roller is, for example, a drum of a carder, wherein the oppositely situated, clothed and/or non-clothed component is, for example, a take-off roller, a revolving flat, or a cladding segment having a guide surface. The so-called carding gap is located between the roller and the component that is at a distance. This carding gap is very narrow and can change, for example during operation of the machine, by the components becoming heated. In this case, contact can occur between the rapidly rotating roller and the oppositely situated component. Such contacts are to be avoided as far as possible.

In DE 10 2006 002 812 A1, it is accordingly proposed as a remedy to avoid undesirably frequent contact between the components, and therefore damage to the clothing, by determining the quantity of contacts, therefore avoiding a notification or reaction when there is only one such contact, or only a slight contact. In particular, an undesired shutdown of the machine is thereby avoided. In order to achieve this, an evaluation of the number of contacts having a certain contact duration, for example a contact duration of 0.1 ms, 1 ms or 2 ms, is filtered. For this purpose, there is a counting device which determines the number of contacts between a card clothing and a clothing strip per unit of time. This number or quantity of contacts is used for further evaluation and for the resulting reaction, for example for stopping the carder or for further operation of the carder.

Furthermore, CH 695 351 A5 discloses a device for determining contact between two components. Contact between the tips of the clothing of the countersurface, formed as at least one revolving flat bar, and the tips of the clothing of the roller, formed as a drum, can be brought about by displacing the revolving flat bars; this contact can be determined by a sensor device, wherein sound measurement of a structure-borne sound transmitted to the machine or a resistance or current measurement in a circuit applied through the contacting components is used to determine the contact.

Various contactless measuring methods and corresponding devices for determining the distance or contact of clothing tips in textile machines are also known. Thus, for example, DE 42 35 610 A1 discloses an inductive sensor that is assigned to the revolving flat of a carder and is situated opposite the clothing of the drum. DE 102 51 574 A1 describes an optical sensor which is capable of acquiring the distance between the free ends of the clothings and corresponding reference surfaces. DE 39 13 996 A1 also discloses contactless sensors, wherein capacitive, inductive, and optical sensors are mentioned.

Indirect measurement methods may also be used. Indirect measurement methods are those in which the immediate distance of the oppositely situated clothing tips is not measured. An example of this is described in DE 42 35 610 A1, cited above, which discloses a distance measurement of the clothing of the drum from a revolving flat bar in which only the sensors are accommodated. According to DE 39 13 996 A1, sensors are provided on the end faces of the clothings, which are assigned to the drum and which measure the distance to oppositely situated counterpieces on the revolving flat. It is also known to determine the distance between the sliding shoes, which are attached to the revolving flat bars via revolving flat heads, and the revolving flat clothing. The immediate distance to the clothing tips is then deduced from these indirect distance measurements, whereby contact can be determined.

The known methods and measuring techniques have the disadvantage that a determination of a contact can only be determined with a great technical effort.

SUMMARY OF THE INVENTION

An object of the invention is to overcome the disadvantages of the prior art and to enable a determination of a contact of two vis-à-vis situated components, or clothings, with high accuracy. Additional objects and advantages of the invention will be set forth in part in the following description, or may be obvious from the description, or may be learned through practice of the invention.

The objects are achieved by the features in described and claimed herein.

A novel carder having a drum designed as a hollow cylinder having a drum wall and with working elements is proposed, wherein the drum has a longitudinal axis, a circumference, an outer surface and a length and is provided with a clothing on its outer surface. The working elements are arranged vis-à-vis the outer surface of the drum. The drum is formed along the longitudinal axis with two stub axles or a continuous axle, wherein the stub axles or the axle are connected to the drum wall by spokes or disks. On a side of the drum wall facing the longitudinal axis or on the stub axles or on the axle or on the spokes or on the disks, at least one acceleration sensor for measuring structure-borne sound is mounted within the length of the drum. Thus, the acceleration sensor is attached to a rotating element, wherein the element is the drum wall itself or performs a rotational movement synchronous with the drum wall. The acceleration sensor measures the structure-borne sound resulting from operation of the carder and transmitted via the various components. When the moving components or their surfaces or clothings come close to one another, the components and the air in the immediate vicinity of the components are made to vibrate. This vibration is conducted by the components and is referred to as structure-borne sound. For example, contact between a working element of the clothing (saw teeth) of the drum produces a characteristic noise. If the working element is realized as a revolving flat with clothing formed by needles, structure-borne sound is generated as soon as there is contact between individual needles of a clothing of a revolving flat and individual saw teeth of the clothing of the drum. The intensity and the frequency of this structure-borne sound are dependent on various machine and process parameters, such as: a speed of the components in themselves or relative to one another, the type, shape and nature of the surfaces of the components, the material of the components and, not least, also the actual contact of the components moving past each other. In particular, the periodicity of the sawtooth clothing of the drum, the drum rotational speed, and the drum radius are determining factors for the intensity (amplitude) and frequency.

The structure-borne sound is caused when the needles of the revolving flat clothing contact the saw teeth of the drum clothing. In order to detect the best possible signal, it is advantageous if the structure-borne sound sensor is attached as close as possible to the point of origin of the structure-borne sound. All transitions and especially bearings act as a filter for the structure-borne sound, as a result of which only a portion of the actually generated structure-borne sound can be acquired by the sensor. In addition, there are bearing noises which cause a basic noise level. By filtering the sound emissions measured in the form of structure-borne sound, it is possible to eliminate the structure-borne noise of the bearing noises or other components of the carder so that contact can be detected.

Due to the fact that the intended arrangement of the acceleration sensor is within the length of the drum and thus on the drum itself, the acceleration sensor is attached to a rotating element. As a result, the structure-borne sound produced at the circumference of the drum has to overcome no or few material transitions between the location of its production and the location of the measurement, as a result of which interfering noises, such as those that arise for example due to the bearing, can be largely masked out. Attaching the acceleration sensor to the rotating element also has the advantage that the measurement of the structure-borne sound always occurs at the same position in relation to the drum wall, and thus it can be determined where the contact has occurred in relation to the drum circumference.

Preferably, two to eight acceleration sensors are arranged on the side of the drum wall facing the longitudinal axis, evenly distributed over the circumference and length of the drum. Due to the fact that the acceleration sensor is attached directly to the drum wall, a high number of transitions which the structure-borne noise has to pass through from one material to another are avoided. An arrangement of a plurality of acceleration sensors promotes an error-free determination of contacts. A fine network of acceleration sensors enables the detection of the slightest contacts, for example a touching of a single needle of a revolving flat clothing with a tip of a saw tooth of the drum clothing. This makes it possible to detect minute contacts of the two clothings and to initiate corresponding countermeasures.

Alternatively, at least two acceleration sensors can be arranged on the spokes or disks. By arranging the acceleration sensors on the spokes or disks, the perception of structure-borne sound is somewhat weakened by the distance from the drum wall, but has the advantage of less influence on the performance of the drum. The effects on the concentricity of the drum are correspondingly smaller. With an arrangement of two acceleration sensors, the disadvantage of weaker transmission of structure-borne sound can be at least partially compensated.

By equipping the drum drive with a rotational angle measurement by a so-called index sensor, the position of the sensors relative to the machine can be acquired during each individual revolution of the drum. For each revolution of the drum, the index sensor indicates the position (azimuth) 0°. Therefore, at all times an exact position of the sensors is known, measured at an angle of rotation about the longitudinal axis of the drum. In this way, when contact occurs, it can for example be determined, through a corresponding evaluation of the measurements of the structure-borne sound, which of the revolving flat bars running along a surface of the drum caused this contact. It is also possible to determine whether the measured contacts took place due to an uneven expansion of the drum.

Likewise, the position can be located not only over the circumference of the drum, but also along its length. This is achieved by arranging the at least two acceleration sensors at opposite ends of the drum as seen in the direction of the longitudinal axis. In this way, it can be determined for example that, due to a bending of the revolving flat bars resulting for example from excessive temperature development, a contact of the clothing of the revolving flat bars with the drum clothing in a certain region of the length of the drum has taken place or become more frequent.

Advantageously, the at least two acceleration sensors are arranged spaced apart in the direction of the longitudinal axis by at least one third of the length and in a circumferential direction of the drum by 180 angular degrees. Due to an appropriate distance between the individual acceleration sensors, it is possible to detect the differences in the received signals and evaluate them accordingly. In this manner, interfering noise or background noise caused by the operation of the machine can be reliably filtered out. Also, a more precise determination of the location of the contact is possible by such an arrangement of the acceleration sensors.

Preferably, the acceleration sensors have a measurement range from 10 kHz to 500 kHz. Experience has shown that the structure-borne sound generated by contact between the needles of the revolving flat bars and the clothing of the drum can be detected in a range from 10 kHz to 500 kHz, wherein a limitation is advantageous due to interfering noise in the high and low frequency range. A larger measurement range would mean a correspondingly higher outlay with respect to filters, in order to eliminate the interfering noises. Preferably, an evaluation is provided in a range of 10 kHz to 300 kHz. In a spectral analysis, a main component of the structure-borne sound generated by the contacts of needles and saw teeth is evaluated in a frequency range of 10 to 30 kHz.

Advantageously, an evaluation unit which, when a certain sound level is exceeded, provides a display for visualizing and for forwarding a signal to a controller of the carder. The evaluation unit records the signals of the acceleration sensors and evaluates them such that actual contact between the components can be recognized. Advantageously, the evaluation unit is attached to the drum wall or to a spoke or disk. Alternatively, the evaluation unit can be mounted on the axle or a stub axle. The closer to the measurements the evaluation unit is attached, the easier the evaluation itself is. Also, if the signal transmission is limited to the results of the evaluation unit, it is less susceptible to interference than a transmission of the measurement results of all acceleration sensors.

The signal transmission from the evaluation unit to a controller of the carder can be done conventionally via a sliding contact. However, it is advantageous if wireless signal transmission is provided between the evaluation device and the controller. When there is a wireless transmission, there is no wear of the transmission elements, and the equipment can be used without maintenance.

In a further alternative embodiment, the evaluation unit is arranged outside the drum in a stationary and rotationally fixed position. This enables a secure wired signal transmission of the evaluated measurement signal.

The same principle applies to the necessary energy supply of the acceleration sensors and the evaluation unit. The energy can likewise be supplied conventionally via sliding contacts. However, it is advantageous if an energy supply to the acceleration sensors and/or the evaluation device is provided by an open rotating transformer or an open electric motor. These energy supplies between stationary and rotating components are prior art and have proven themselves in use. As an alternative, inductive energy transfer by wireless charging modules can be used. Wireless charging modules use an electromagnetic field to transmit energy between two objects. The energy is sent via an inductive coupling to an electrical device which can then use this energy for charging batteries or for operating the device.

Through a corresponding evaluation of the measurements of the structure-borne sound, contacts between the surface of the drum, or the clothing on the surface, and a wide range of components situated vis-à-vis the drum can be determined. In this case, the components situated opposite the drum may be designed as blades, guide plates, carding elements, revolving flats, or clothed rollers.

Furthermore, it is advantageous if an input device and/or a detection device is provided for inputting or identifying the clothing type of the clothing of the drum, the surface structure of the vis-à-vis situated components, and/or of production-dependent variables, in particular the production rate, the type and/or the moisture of the fibers. This improves the evaluation of the measurement of the structure-borne sound. The controller, or its software, can take into account these factors influencing the structure-borne noise production when evaluating the results of the measurements of the acceleration sensors, and can accordingly generate a more accurate signaling of potential hazards.

A method is further proposed for operating a carder having a drum with a clothing of a certain clothing type and working elements situated vis-à-vis to the drum. The drum is provided with at least one acceleration sensor by which a sound level of a structure-borne sound is measured. From the measured sound level, a contact of the clothing of the drum with the vis-à-vis situated working element is determined.

Preferably, when an upper limit level is exceeded or a certain duration of a lower limit level is exceeded, the carder is switched off. It is advantageous to predict possible crashes in order to be able to react accordingly so as to prevent or minimize machine damage. With structure-borne sound monitoring, this is possible under corresponding conditions. Strong structure-borne noise is caused by a crash. If the sound amplifier or the evaluation is set so that, during normal operation, the crash threshold is not exceeded, the corresponding output can be used as crash detection. The corresponding input of the machine controller has to be fast in order to react accordingly, for example by switching off a material feed, reducing the rotational speed, or disconnecting the drum or lifting the component situated vis-à-vis the drum. If a lower limit level is permanently undershot, it is to be concluded that either no carding is taking place or the acceleration sensors have failed. For safety reasons, the carder is also switched off in such a case, since it is no longer ensured that problematic contact can be detected in good time.

BRIEF DESCRIPTION OF THE DRAWINGS

Further advantages of the invention are described in the following exemplary embodiments. In the drawings.

DETAILED DESCRIPTION

Figure 1:
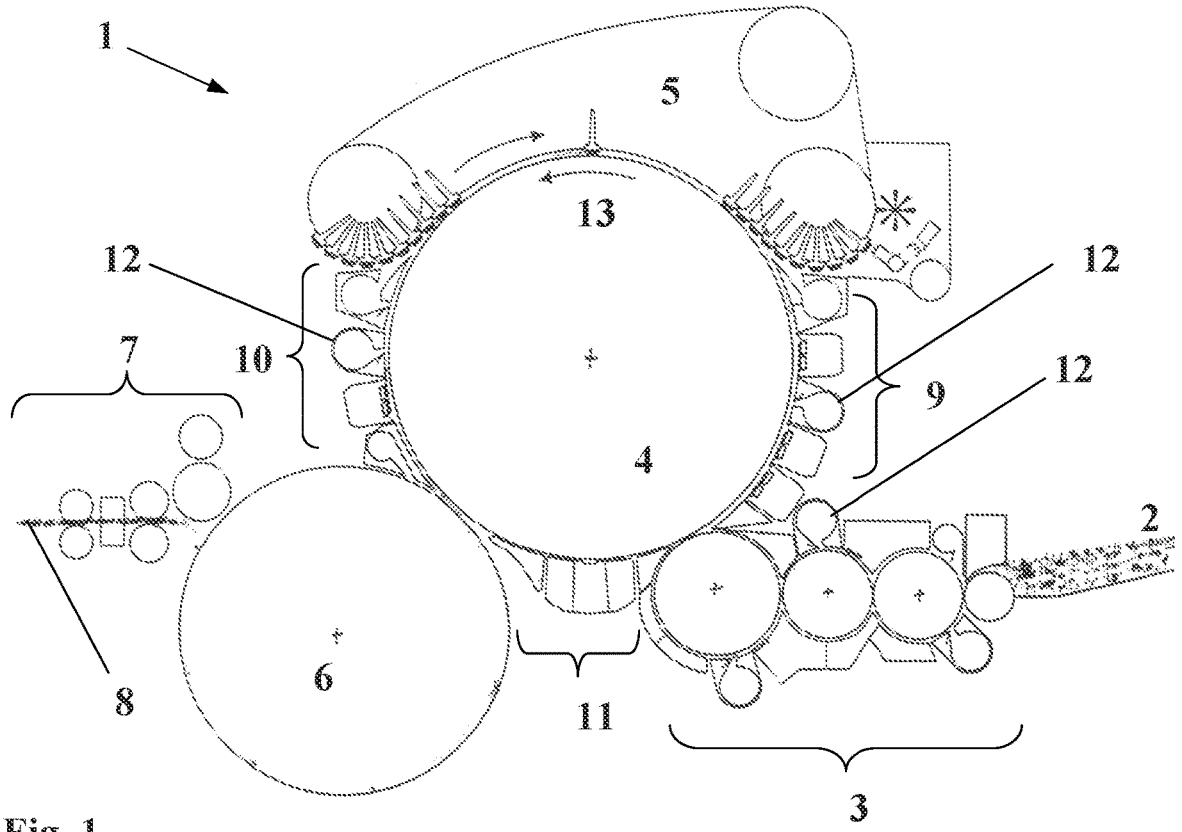
FIG. 1 shows a schematic representation of a carder according to the prior art.

Reference will now be made to embodiments of the invention, one or more examples of which are shown in the drawings.

FIG. 1 shows, in a schematic representation, a carder 1 according to the prior art. After it has passed through various blowroom process stages, fiber material 2 moves into a licker-in 3. The fiber material 2 is opened by the rollers and working elements 12 contained in the licker-in 3, and at the same time is freed of a portion of the impurities contained therein. The last roller of the licker-in 3 transfers the fiber material finally to the drum 4 of the carder 1, which completely separates the fiber material into individual fibers, cleans it, and parallelizes it. For this purpose, the drum 4 works together with revolving flats 5 and other various working elements 12. The drum 4 is moved in a direction of rotation 13 and guides the fibers from the licker-in 3 to the doffer 6. In so doing, the fibers are conveyed through a pre-carding zone 9, subsequently past the revolving flats 5, and then via a post-carding zone 10 to the doffer 6. Working elements 12 are used both in the pre-carding zone 9 and in the post-carding zone 10. Among other things, carding elements for parallelizing the fibers and separating elements for separating trash parts and short fibers are used as working elements 12 in the pre-carding zone 9 and the post-carding zone 10. Between the doffer 6 and the licker-in 3, the fiber material remaining on the drum passes through a sub-carding zone 11, as seen in the direction of rotation 13 of the drum 4. Currently, usually no separating elements are used in the sub-carding zone 11. After the fibers have carried out a plurality of revolutions on the drum 4, they are removed from the drum 4 by the doffer 6 in the form of fiber mat, and are reshaped with a sliver forming unit 7 to form a card sliver 8. The card sliver 8 is then placed into a can for further transport (not shown).

Figure 2:
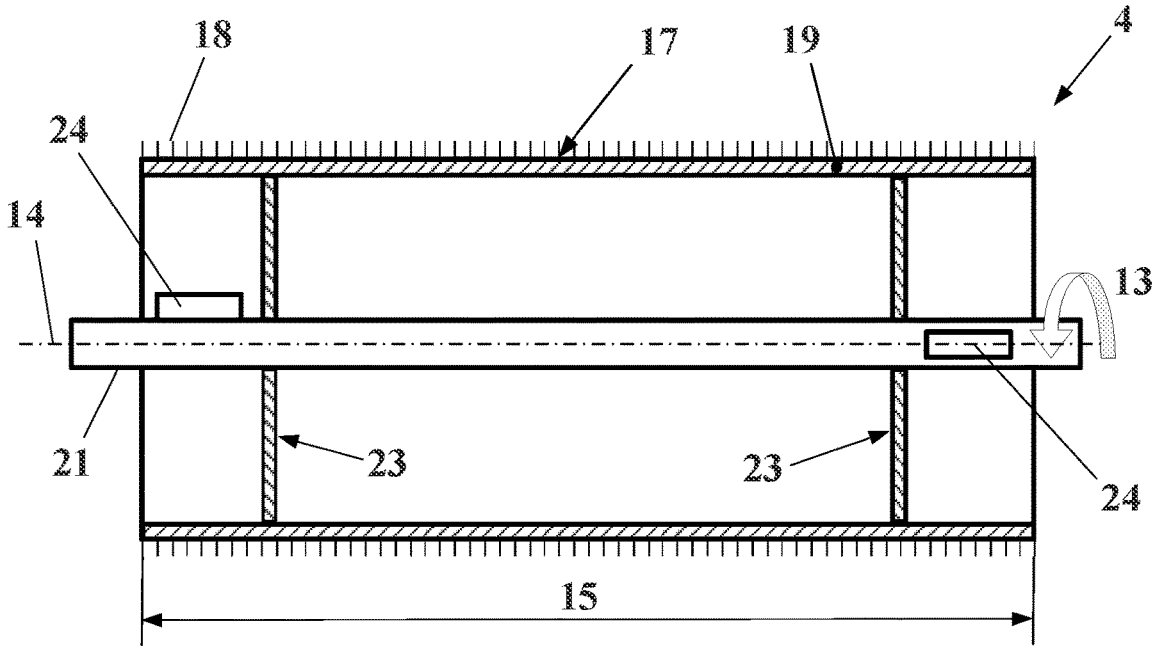
FIG. 2 shows a schematic representation of a drum according to the invention in a first embodiment.

FIG. 2 shows a schematic representation of a drum 4 according to the invention in a first embodiment. The drum 4 is designed as a hollow cylinder having a drum wall 19 and a longitudinal axis 14. To support the hollow cylinder, two disks 23 are inserted into the hollow cylinder, which connect the drum wall 19 to an internal continuous axle 21 extending over the entire longitudinal axis 14 of the drum 4. The axle 21 extends over a greater length than the length 15 of the drum 4, in such a manner that a bearing of the drum 4 can be provided at both axle ends. In these bearings (not shown), the drum 4 rotates in the direction of rotation 13. A clothing 18 is applied on an outer surface 17 of the drum. Such clothings 18 are usually designed as sawtooth clothings and are wound onto the drum 4 in wire form. Two acceleration sensors 24 are mounted on the axle 21 for measuring a structure-borne sound.

Figure 3:
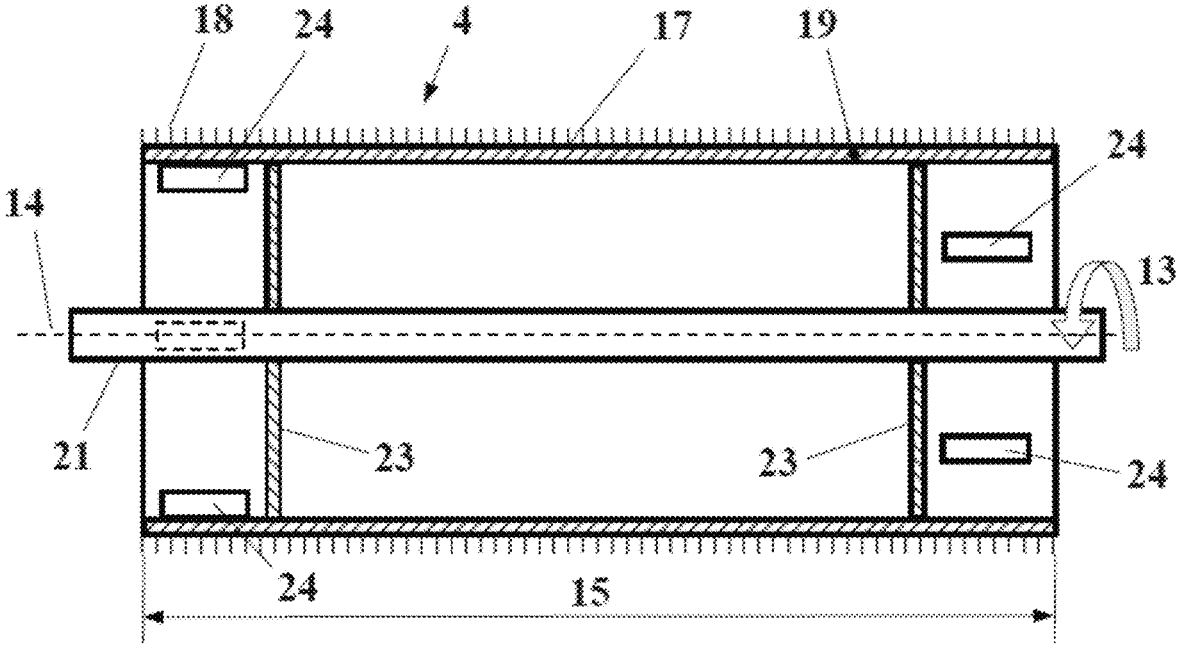
FIG. 3 shows a schematic representation of a drum according to the invention in a second embodiment.

FIG. 3 shows a schematic representation of a drum 4 according to the invention in a second embodiment. The drum 4 has the same design as the drum 4 in FIG. 2, which is why reference is made to the description of FIG. 2 for a description of the individual components of the drum 4. In contrast to FIG. 2, FIG. 3 shows eight acceleration sensors 24 mounted on the drum wall 19, namely on a side of the drum wall 19 facing the axle 21. The acceleration sensors are provided to the left and right of the disks 23, wherein the arrangement is to be regarded as an example, and wherein it should be noted that the acceleration sensors 24 are spaced as far apart as possible in the direction of the longitudinal axis 14 and are evenly distributed over the circumference of the hollow cylinder.

Figure 4:
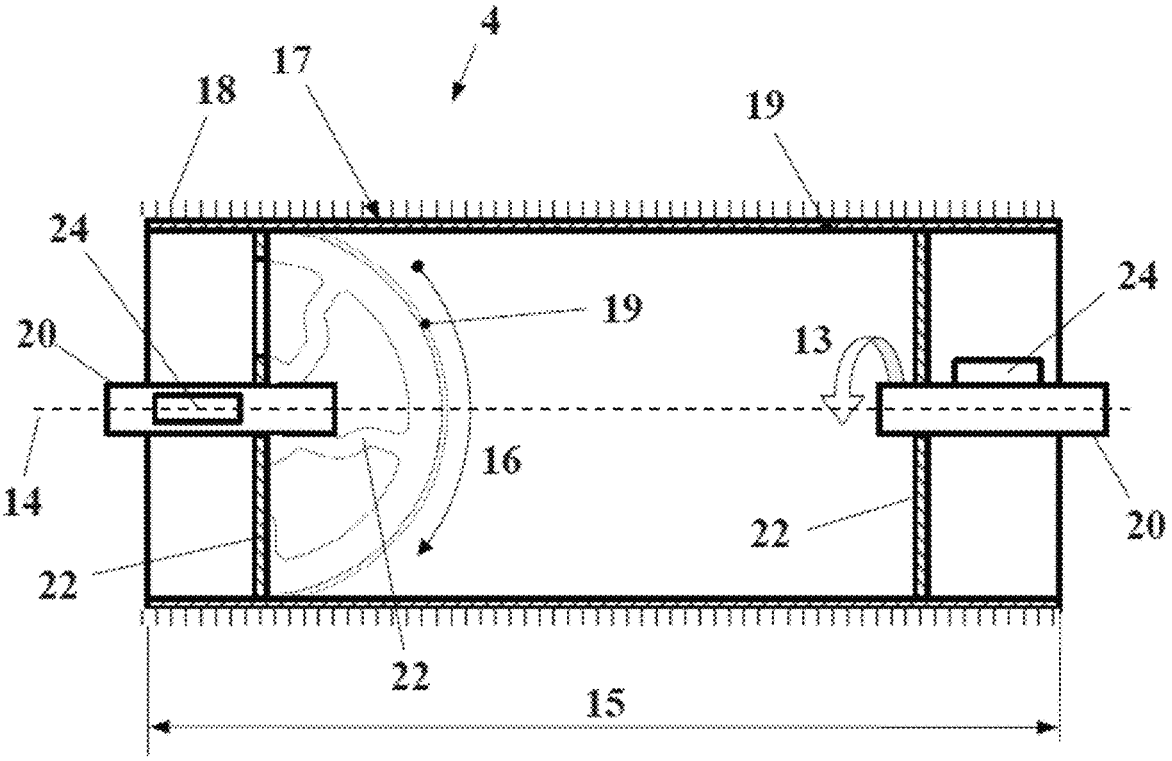
FIG. 4 shows a schematic representation of a drum according to the invention in a third embodiment.

FIG. 4 shows a schematic representation of a drum 4 according to the invention in a third embodiment. The drum 4 is also designed as a hollow cylinder having a length 15, a drum wall 19, and a longitudinal axis 14. To support the hollow cylinder, spokes 22 are inserted into the hollow cylinder at two points, connecting the drum wall 19 to internal stub axles 20 extending over a part of the longitudinal axis 14 of the drum 4. A half view shows a possible embodiment of the spokes 22 with their connection to the drum wall 19 and the stub axles 20. The stub axles 20 are arranged on both sides of the drum 4, so that a bearing of the drum 4 can be provided at both axle ends. In these bearings (not shown), the drum 4 rotates in the direction of rotation 13. A clothing 18 is applied on an outer surface 17 of the drum around the entire circumference 16 of the drum 4. An acceleration sensor 24 is mounted on each of the stub axles 20 for measuring a structure-borne sound.

Figure 5:
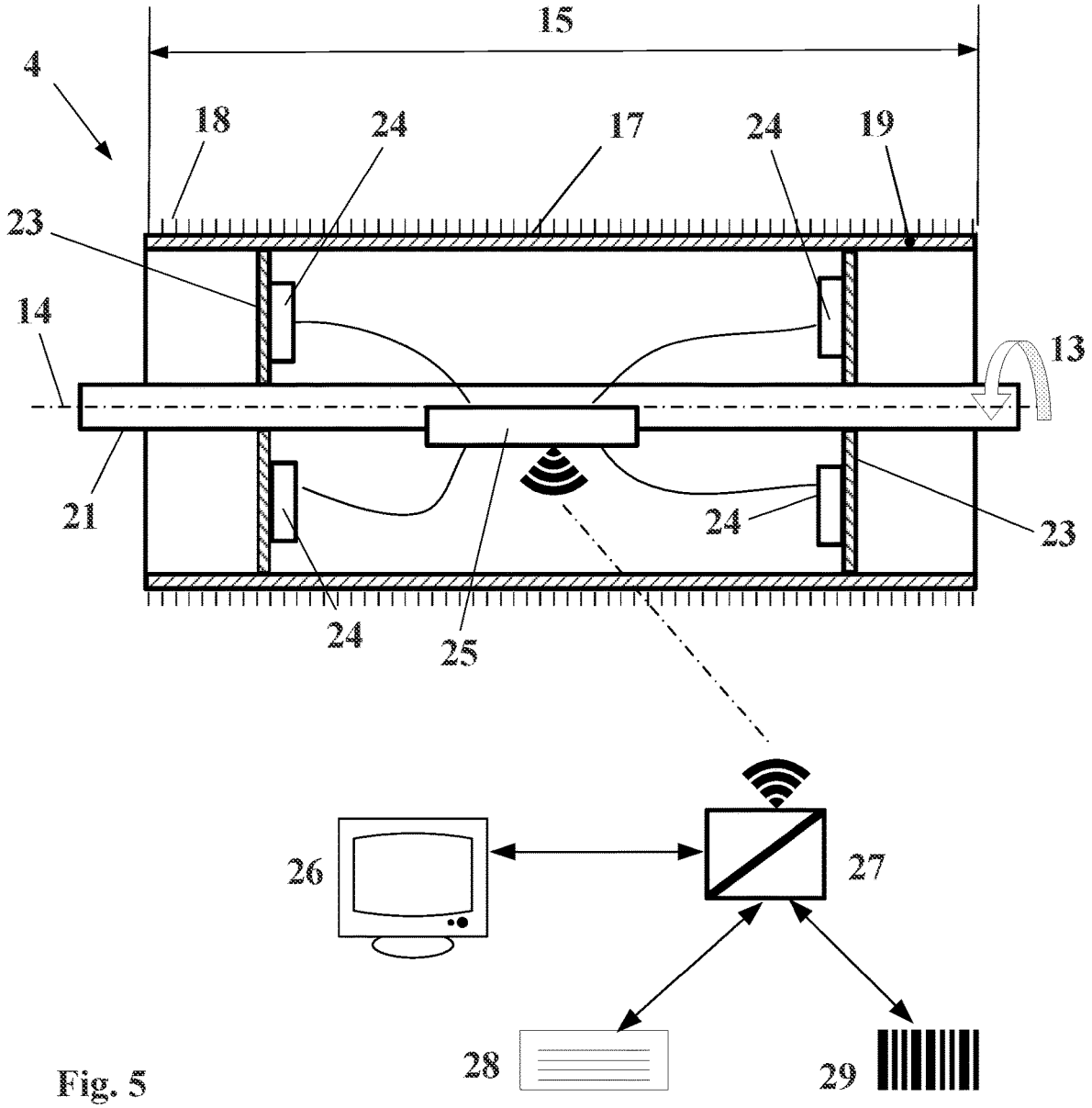
FIG. 5 shows a schematic representation of a configuration of the method according to the invention.

FIG. 5 shows a schematic representation of a configuration of the method according to the invention. The drum 4 is designed as a hollow cylinder having a drum wall 19 and a longitudinal axis 14. To support the hollow cylinder, two disks 23 are inserted into the hollow cylinder, which connect the drum wall 19 to an internal continuous axle 21 extending over the entire longitudinal axis 14 of the drum 4. The axle 21 extends over a greater length than the length 15 of the drum 4, in such a manner that a bearing of the drum 4 can be provided at both axle ends. In these bearings (not shown), the drum 4 rotates in the direction of rotation 13. A clothing 18 is applied on an outer surface 17 of the drum. Acceleration sensors 24 are mounted on each of the disks 23. The acceleration sensors 24 are connected to an evaluation unit 25, which is attached to the axle 21 by way of example. Thus, the entire measuring system moves together with the drum in the direction of rotation 13. The signals of the evaluation unit 25 are transmitted wirelessly, for example via WiFi, to a controller 27.

The controller 27 is connected to a display 26 and to an input device 28. The display 26 is activated by the controller 27 as soon as an unexpected situation results from the evaluation of the acceleration sensor 24. For example, if a sound level is exceeded because there has been contact between the clothing 18 and a working element vis-à-vis the clothing 18. The input device 28 can be used to access the setpoint values or limit values of the structure-borne sound measurement stored in the controller 27. In order to achieve an improvement of the structure-borne sound measurement, the components used on the drum, such as the clothing type of the clothing 18 of the drum 4, the surface structure of the vis-à-vis situated working elements can be transmitted to the controller 27 via the input device 28. Furthermore, it is also possible to input production-dependent variables, in particular the production rate, the type and/or the moisture of the fibers. In the case of a more advanced automation of the carder, a detection device 29, which recognizes the employed components of the drum 4, is linked to the controller 27. For example, via barcode recognition, when working elements are exchanged, their properties or even the properties of the fibers to be processed can be read directly into the controller 27 without having to use the input device 28.

The present invention is not limited to the shown and described embodiments. Modifications within the scope of the claims are possible, as well as a combination of the features, even if these are shown and described in different embodiments.

KEY

1 carder
2 fiber material
3 licker-in
4 drum
5 revolving flat

6 doffer
7 sliver-forming unit
8 fiber sliver
9 pre-carding zone
10 post-carding zone
11 sub-carding zone
12 working element
13 direction of rotation
14 drum longitudinal axis
15 drum length
16 drum circumference
17 drum surface
18 drum clothing
19 drum wall
20 stub axle
21 axle
22 spoke
23 disk
24 acceleration sensor
25 evaluation unit
26 display
27 controller
28 input device
29 recognition/detection device

The invention claimed is:

1. A carder, comprising:

a controller;

a drum comprising a hollow cylinder having a drum wall, a longitudinal axis, a circumference, an outer surface, a length, and a clothing provided on the outer surface;

working elements arranged relative to the outer surface of the drum;

stub axles or a continuous axle formed along the longitudinal axis of the drum and connected to the drum wall by spokes or disks;

one or more acceleration sensors that measures structure-borne sound mounted directly on and rotatable with one or more of: a side of the drum wall facing the longitudinal axis, the stub axles, the continuous axle, the spokes, or the disks within the length of the drum.

2. The carder according to claim 1, comprising from two to eight of the acceleration sensors arranged on the side of the drum wall facing the longitudinal axis and are arranged uniformly distributed over the circumference and the length of the drum.

3. The carder according to claim 1, comprising at least two of the acceleration sensors are arranged on the spokes or the disks.

4. The carder according to claim 1, comprising at least two of the acceleration sensors arranged spaced apart in a direction of the longitudinal axis by at least one third of the length and by at least 180 angular degrees in a circumferential direction of the drum.

5. The carder according to claim 1, wherein the one or more acceleration sensors have a measurement range from 10 KHz to 500 KHz.

6. The carder according to claim 1, further comprising an evaluation unit configured to, upon a certain sound level being exceeded, provide a display that visualizes the sound level and forward a signal to the controller.

7. The carder according to claim 6, wherein the evaluation unit is attached to one of: the drum wall, the spoke, or the disk.

8. The carder according to claim 6, wherein the evaluation unit is mounted to one of the stub axles or the continuous axle.

9. The carder according to claim 6, wherein the evaluation unit is arranged outside the drum in a stationary and rotationally fixed position.

10. The carder according to claim 6, wherein the evaluation unit wirelessly communicates with the controller and with the one or more acceleration sensors.

11. The carder according to claim 6, wherein energy is supplied to the evaluation unit and the one or more acceleration sensors by an electric motor.

12. The carder according to claim 6, wherein energy is supplied to the evaluation unit and the one or more acceleration sensors by a wireless inductive charging module.

13. The carder according to claim 1, further comprising an input device or a detection device to input or automatically recognize one or more of: a type of the clothing on the drum, a surface structure of the working elements, or production-dependent variables of the carder.

14. A method for operating the carder according to claim 1, comprising determining a contact of the clothing with needles of revolving flat bars from a measured sound level detected by the one or more acceleration sensors.

15. The method according to claim 14, comprising switching off the carder when an upper limit level is exceeded or a certain duration of the contact or a lower limit level of the contacts is exceeded.

* * * * *